US012565289B2

(12) United States Patent
Xiong et al.

(10) Patent No.: US 12,565,289 B2
(45) Date of Patent: Mar. 3, 2026

(54) RETRACTABLE HYDROFOIL SYSTEM FOR MULTI-HULL VESSEL

(71) Applicant: Hangzhou Sino Eagle Yacht Co., Ltd., Fuyang Hangzhou (CN)

(72) Inventors: Ying Xiong, Fuyang Hangzhou (CN); Jure Zule, Fuyang Hangzhou (CN); ShuKa Fan, Fuyang Hangzhou (CN); LiangGang He, Fuyang Hangzhou (CN); Christopher Peart, Birmingham (GB)

(73) Assignee: HANGZHOU SINO EAGLE YACHT CO., LTD., Fuyang Hangzhou (CN)

( * ) Notice: Subject to any disclaimer, the term of this patent is extended or adjusted under 35 U.S.C. 154(b) by 468 days.

(21) Appl. No.: 18/179,585

(22) Filed: Mar. 7, 2023

(65) Prior Publication Data

US 2024/0300620 A1 Sep. 12, 2024

(51) Int. Cl.

| | |
|---|---|
| ***B63B 1/30*** | (2006.01) |
| ***B63B 1/12*** | (2006.01) |
| ***B63B 1/26*** | (2006.01) |

(52) U.S. Cl.

CPC ..... *B63B 1/30* (2013.01); *B63B 1/121* (2013.01); *B63B 1/26* (2013.01)

(58) Field of Classification Search

CPC .. B63B 1/00; B63B 1/121; B63B 1/26; B63B 1/30; B63B 1/20; B63B 1/246; B63B 1/248; B63B 1/28

USPC ..... 114/282

See application file for complete search history.

(56) References Cited

U.S. PATENT DOCUMENTS

| | | | |
|---|---|---|---|
| 2,749,870 | A | 6/1956 | Vavra |
| 2,991,747 | A | 7/1961 | Bader |
| 3,081,728 | A | 3/1963 | Wilterdink |
| 3,164,117 | A | 1/1965 | Lopez |
| 3,180,300 | A | 4/1965 | Singlemann |
| 3,183,871 | A | 5/1965 | Reder |
| 3,185,120 | A | 5/1965 | Bader |
| 3,199,483 | A | 8/1965 | Ellzey |
| 3,343,513 | A | 9/1967 | Bader |
| 3,354,857 | A | 11/1967 | Hobday |
| 3,357,389 | A | 12/1967 | Wray, Jr. |
| 3,456,611 | A | 7/1969 | Johnson |
| 3,613,622 | A | 10/1971 | Bueller |
| 3,745,959 | A | 7/1973 | Coffey |
| 3,800,727 | A | 4/1974 | Stark |
| 3,804,047 | A | 4/1974 | Faber |

(Continued)

FOREIGN PATENT DOCUMENTS

| | | | |
|---|---|---|---|
| AU | 2012101872 | A | 4/2013 |
| CN | 101712372 | B | 4/2012 |

(Continued)

OTHER PUBLICATIONS

US 10,647,386 B2, 05/2020, Schnauffer (withdrawn)

*Primary Examiner* — Lars A Olson

(74) *Attorney, Agent, or Firm* — ALLEN, DYER, DOPPELT & GILCHRIST, P.A.

(57) ABSTRACT

A multi-hull marine vessel includes a retractable hydrofoil system having a pair of retractable foils mounted to deploy from opposite sides of a tunnel defined between adjacent hulls. The foils are pivotably mounted to respective bottoms of the hulls and retract behind respective steps formed therein.

18 Claims, 5 Drawing Sheets

(56) References Cited

U.S. PATENT DOCUMENTS

| | | | | |
|---|---|---|---|---|
| 3,910,215 | A | 10/1975 | Soderman | |
| 3,968,762 | A | 7/1976 | Meyer, Jr. | |
| 4,159,690 | A | 7/1979 | Farris | |
| 4,178,871 | A | 12/1979 | Hirsch | |
| 4,182,256 | A | 1/1980 | Scott | |
| 4,499,843 | A | 2/1985 | Williams | |
| 4,936,240 | A | 6/1990 | Yokoyama | |
| 4,955,312 | A | 9/1990 | Magazzu | |
| 5,054,410 | A | 10/1991 | Scarborough | |
| 5,117,776 | A | 6/1992 | Thorpe | |
| 5,311,832 | A | 5/1994 | Payne | |
| 5,329,870 | A | 7/1994 | Cook | |
| 5,448,963 | A | 9/1995 | Gallington | |
| 5,474,011 | A | 12/1995 | Steinberg | |
| 5,860,381 | A | 1/1999 | Fernandini | |
| 6,164,235 | A | 12/2000 | Hoppe | |
| 6,782,839 | B1 | 8/2004 | Nozaki | |
| 6,886,481 | B1 | 5/2005 | Lord | |
| 7,140,318 | B1 | 11/2006 | Gasper | |
| 7,232,350 | B1 | 6/2007 | Krah | |
| 7,275,493 | B1 | 10/2007 | Brass | |
| 7,743,720 | B1 | 6/2010 | Salani | |
| 8,051,793 | B2 | 11/2011 | Ulgen | |
| 8,763,551 | B2 | 7/2014 | Martino | |
| 8,820,260 | B2 | 9/2014 | Brizzolara | |
| 8,857,363 | B2 | 10/2014 | Sahlin | |
| 8,893,640 | B2 | 11/2014 | Stephinson | |
| 9,669,903 | B2 | 6/2017 | Gasper | |
| 9,862,458 | B2 | 1/2018 | Van Oossanen | |
| 9,896,162 | B2 | 2/2018 | McClure | |
| 10,000,258 | B2 * | 6/2018 | Curtis | B63B 1/14 |
| 10,363,993 | B2 | 7/2019 | Smith | |
| 10,399,651 | B2 | 9/2019 | McClure | |
| 10,532,793 | B2 | 1/2020 | Lagarrigue | |
| 10,562,592 | B2 | 2/2020 | Minor | |
| 10,625,822 | B1 | 4/2020 | Hynes, Jr. | |
| 10,717,498 | B2 | 7/2020 | Ulgen | |
| 10,829,181 | B2 | 11/2020 | Clark | |
| 10,875,606 | B2 | 12/2020 | Claughton | |
| 11,014,631 | B2 | 5/2021 | Yrke | |
| 11,738,827 | B2 * | 8/2023 | Wessman | B63B 1/30 114/282 |
| 2012/0048165 | A1 | 3/2012 | Westerman | |
| 2014/0109820 | A1 | 4/2014 | Oliver | |
| 2018/0354592 | A1 | 12/2018 | Chaves | |
| 2020/0079479 | A1 | 3/2020 | Derrah | |
| 2020/0247505 | A1 | 8/2020 | Rozand | |

FOREIGN PATENT DOCUMENTS

| | | | | |
|---|---|---|---|---|
| CN | 103328316 | A * | 9/2013 | B63B 39/06 |
| CN | 105923101 | | 9/2016 | |
| CN | 205819478 | U | 12/2016 | |
| CN | 107150760 | A | 9/2017 | |
| CN | 107226169 | | 10/2017 | |
| CN | 206841661 | U | 1/2018 | |
| CN | 108482575 | | 9/2018 | |
| CN | 109178193 | | 1/2019 | |
| CN | 109178194 | | 1/2019 | |
| CN | 107953967 | B | 7/2019 | |
| CN | 110254604 | | 9/2019 | |
| CN | 210212662 | | 3/2020 | |
| CN | 113212084 | | 8/2021 | |
| DE | 1506182 | A1 | 12/1969 | |
| DE | 1531592 | A1 | 3/1970 | |
| DE | 2337994 | A1 | 2/1975 | |
| DE | 3425912 | A1 | 2/1985 | |
| DE | 102015103553 | | 9/2016 | |
| DE | 202018101094 | U1 | 3/2018 | |
| EP | 2353991 | A2 | 8/2011 | |
| EP | 216689 | B1 | 5/2019 | |
| EP | 3514049 | A1 | 7/2019 | |
| FR | 1333275 | A | 7/1963 | |
| FR | 1546885 | A | 11/1968 | |
| FR | 93317 | E | 3/1969 | |
| FR | 2464176 | A1 | 3/1981 | |
| FR | 2563177 | A1 | 10/1985 | |
| FR | 2883254 | | 4/2007 | |
| FR | 3004159 | A1 | 10/2014 | |
| FR | 3089487 | B1 | 2/2021 | |
| FR | 3093990 | B1 | 2/2021 | |
| FR | 310607 | A1 | 4/2021 | |
| GB | 38333 | A | 10/1955 | |
| GB | 1120612 | A | 7/1968 | |
| GB | 1179881 | A | 2/1970 | |
| GB | 1581625 | A | 12/1980 | |
| GB | 1581627 | A | 12/1980 | |
| GB | 2558181 | A | 7/2018 | |
| JP | H05319359 | A | 12/1993 | |
| KR | 20160000507 | | 2/2016 | |
| KR | 101745880 | | 6/2017 | |
| KR | 101751900 | B1 | 6/2017 | |
| RU | 2059513 | C1 | 5/1996 | |
| WO | WO2010098726 | | 9/2010 | |
| WO | WO2019012016 | | 1/2019 | |
| WO | WO2019202220 | | 10/2019 | |
| WO | WO2020056530 | | 3/2020 | |
| WO | WO2020210166 | | 10/2020 | |
| WO | WO2021032277 | | 2/2021 | |
| WO | WO2021064012 | | 4/2021 | |
| WO | WO2021084127 | | 5/2021 | |
| WO | WO2021084128 | | 5/2021 | |
| WO | WO2021084131 | | 5/2021 | |
| WO | WO2021084135 | | 5/2021 | |
| WO | WO202115570 | | 6/2021 | |

* cited by examiner

RETRACTABLE HYDROFOIL SYSTEM FOR MULTI-HULL VESSEL

FIELD OF THE INVENTION

The present invention relates to marine vessels having hydrofoils, and more particularly, to hydrofoil systems incorporating retractable foils.

BACKGROUND OF THE INVENTION

Hydrofoils have been used on marine vessels for over a century. By lifting all or a portion of a vessel's hull out of the water, hydrofoils decrease drag and potentially enable greater speed and/or reduced fuel consumption. Despite this long history and these advantages, relatively few marine vessels employ hydrofoils.

One disadvantage of hydrofoils is a greatly increased draft when the vessel is supported by its hull versus the foils. The usually delicate structure of the foils, themselves, makes them particularly prone to damage. Additionally, when in hull-borne operation, the foils are counterproductive, increasing drag and potentially impairing maneuverability.

To mitigate these disadvantages, hydrofoils that can be partially or fully retracted are sometimes employed. While such retractable hydrofoils can address the above problems, retractability often sacrifices either aesthetics—with foils visibly folding into positions external to the hull, or a significant amount of otherwise useable hull space into which the hydrofoils retract.

SUMMARY OF THE INVENTION

In view of the foregoing, it is an object of the present invention to provide an improved retractable hydrofoil system for a multi-hull vessel. According to an embodiment of the present invention, a marine vessel with a retractable hydrofoil system comprises at least two connected hulls extending in a length direction between forward and aft ends, each hull including at least one step between the forward and aft ends, a bottom of each hull being disposed vertically higher aft of each step than forward of each step. The vessel also includes a hydrofoil system with at least two foils, each of the foils being pivotably mounted to the bottom a respective one of the hulls aft of the step. Each of the foils is movable between a retracted position, in which the foil extends along the bottom of the hull aft of the step and up an inner side of the respective one of the hulls facing the other hull, and a deployed position, in which the foil extends downwardly from the bottom of the hull and toward the other foil.

According to an aspect of the invention, each foil includes a pivot structure pivotably mounted to the bottom of the respective one of the hulls, a proximal foil section connected to the pivot structure, and a distal foil section extending at an angle of less than 180 degrees from the proximal foil section. According to another aspect, in the retracted position, the proximal foil section lies along the bottom of the hull aft of the step and the distal foil section extends along the inner side of the respective one of the hulls. According to a further aspect, each hull includes a foil recess formed in the inner side aft of the step, the distal foil section of each foil being accommodated in the respective foil recess when in the retracted position.

According to an additional aspect of the invention, the pivot structure of each foil is pivotably mounted proximate to a centerline of the bottom of the respective one of the hulls. Advantageously, all of each pivot structure is behind an aft face of the step of the respective one of the hulls.

According to another aspect of the invention, the hydrofoil system includes at least two pivot drives, each of the pivot drives mounted to the respective one of the hulls and engaging a respective one of the pivot structures, each of the pivot drives being operable to pivot a respective one of the foils between the retracted and deployed positions.

According to a method aspect, a method of operating a hydrofoil system of a multi-hull marine vessel, the method comprises deploying a pair of foils from opposite sides of a tunnel defined between adjacent hulls of the marine vessel. Deploying the pair of foils includes deploying the pair of foils such that distal sections thereof are aligned across a width of the tunnel and co-planar. The foils are retracted to a stowed position aft of steps formed in the adjacent hulls on opposite sides of the tunnel.

According to a further aspect, a marine vessel with a retractable hydrofoil system comprises at least two connected hulls extending in a length direction between forward and aft ends and defining a tunnel therebetween, and at least two opposed foils. Each of the foils is attached to a respective one of the hulls and movable between a retracted position laying alongside the respective sides of the tunnel and a deployed position extending below the tunnel and towards the other of the foils.

These and other objects, aspects and advantages of the present invention will be better appreciated in view of the drawings and following detailed description of preferred embodiments.

DETAILED DESCRIPTION OF PREFERRED EMBODIMENTS

Figure 1:
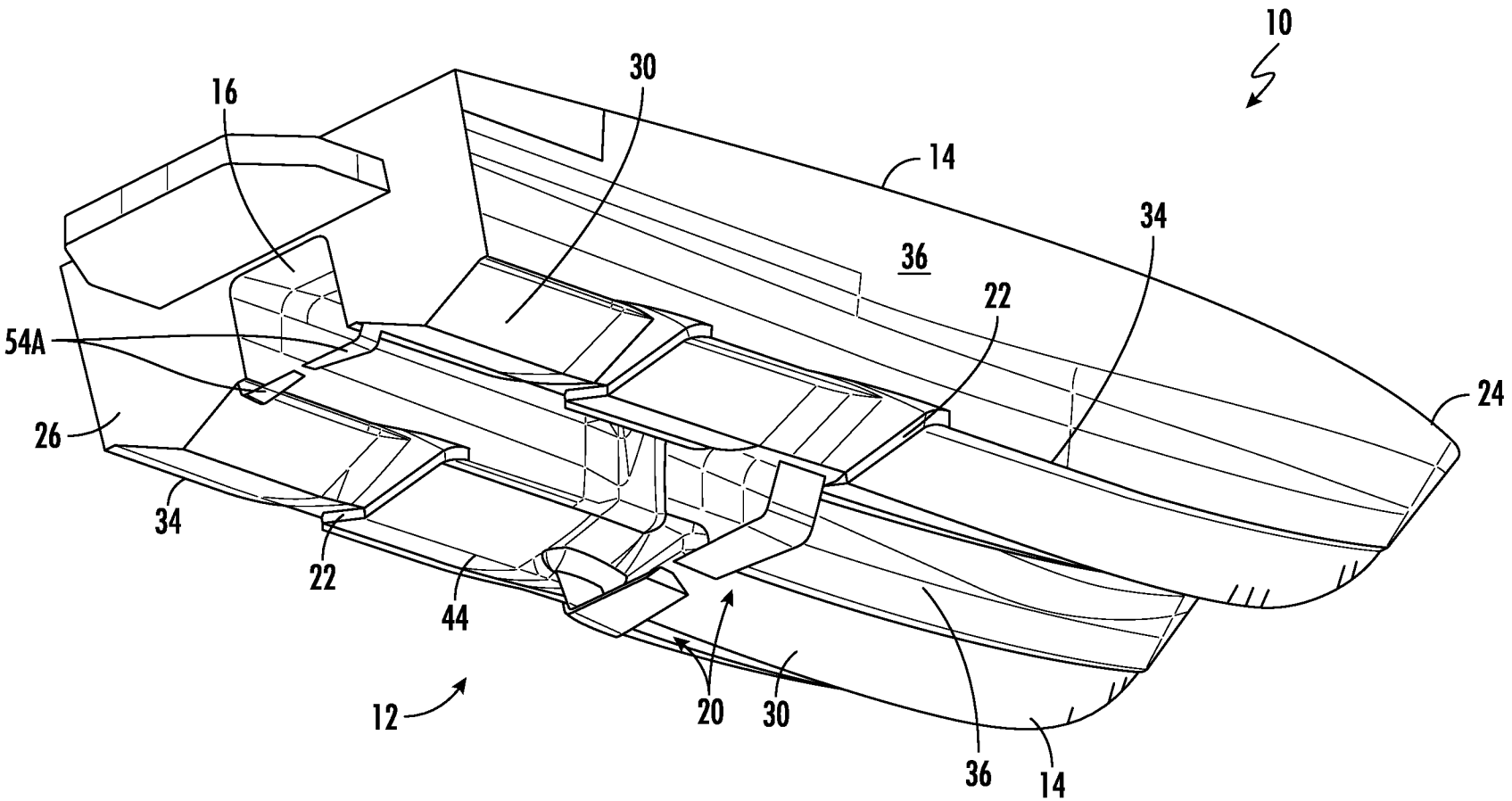
FIG. 1 is perspective view of a multi-hull vessel including a retractable hydrofoil system, according to an embodiment of the present invention, with retractable foils thereof deployed.
Figure 2:
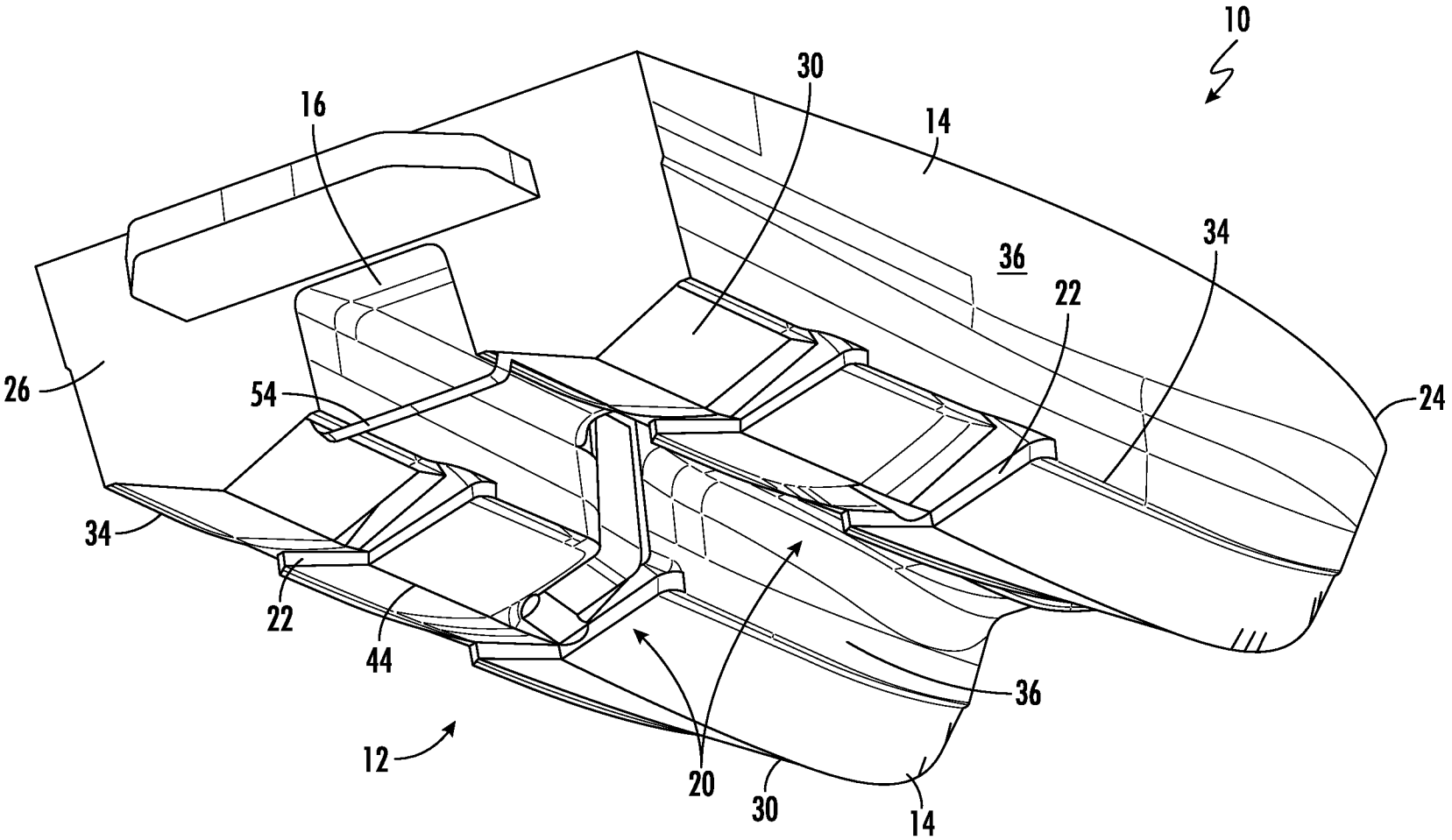
FIG. 2 is another perspective view of the vessel of FIG. 1, with retractable foils thereof retracted and with an alternate embodiment of a rear, fixed foil.
Figure 4:
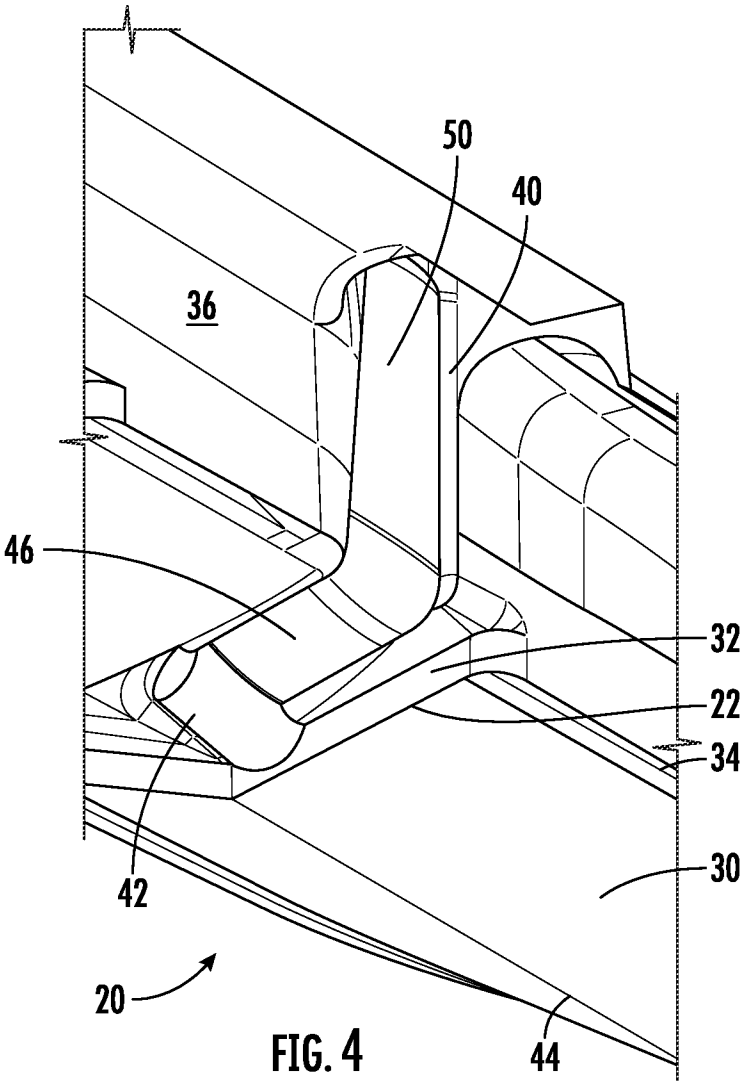
FIG. 4 is a detail perspective view of the exemplary one of the retractable foils of FIG. 3, with the foil retracted.
Figure 3:
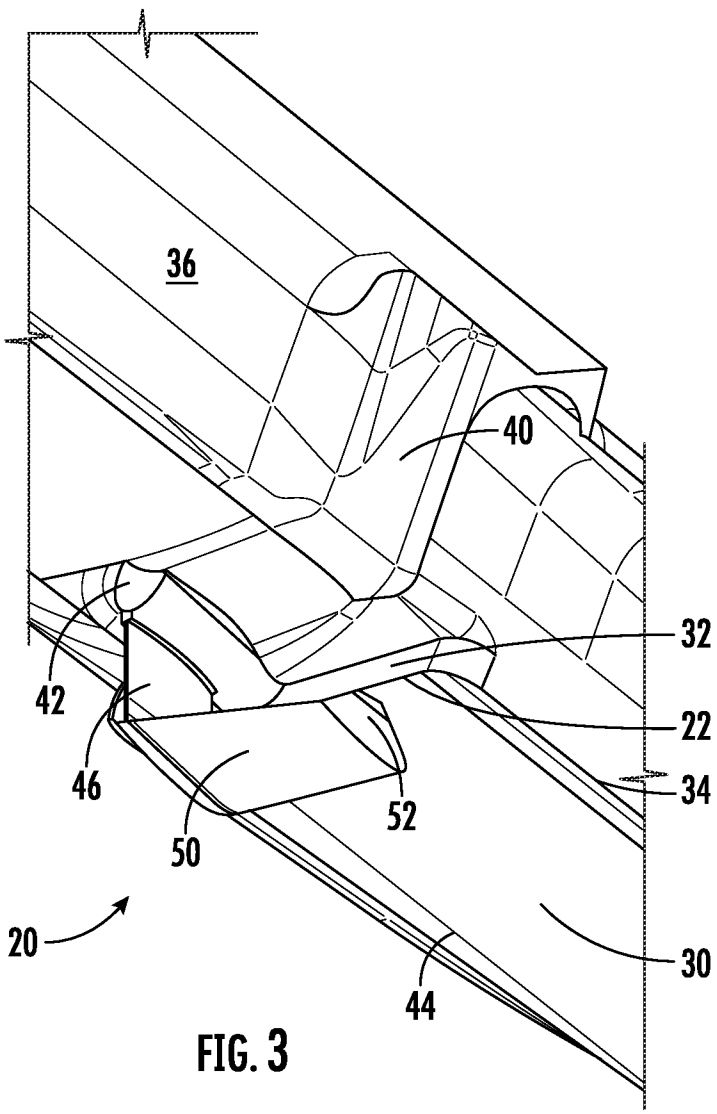
FIG. 3 is a detail perspective view of an exemplary one of the retractable foils of FIG. 1, with the foil deployed.

Referring to FIGS. 1-4, according to an embodiment of the present invention, a multi-hull vessel 10 includes a retractable hydrofoil system 12. The vessel 10 includes at least two hulls 14 defining a tunnel 16 therebetween. The hydrofoil system 12 includes at least two opposed retractable foils 20, each mounted to a respective hull 14, which deploy below the tunnel 16 (as in FIG. 1) and retract under and along the hulls 14 in the tunnel 16 (as in FIG. 2).

Figure 5:
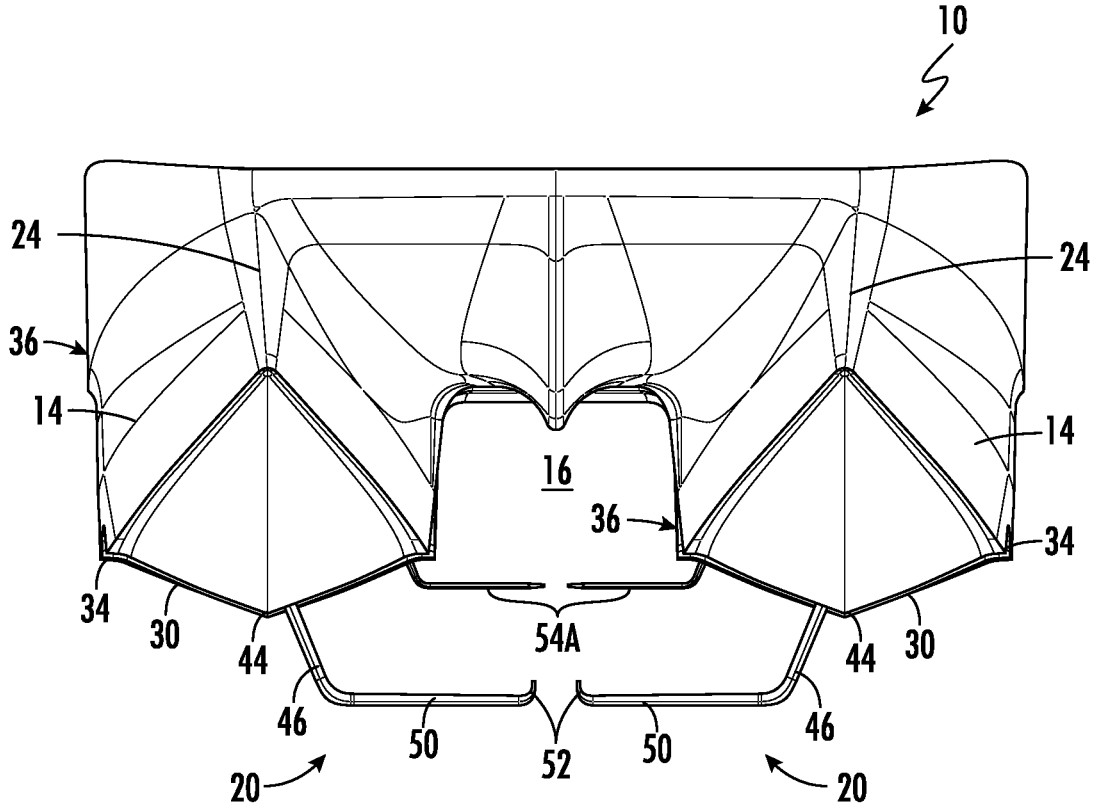
FIG. 5 is a front view of the vessel of FIG. 1, with the retractable foils deployed.
Figure 6:
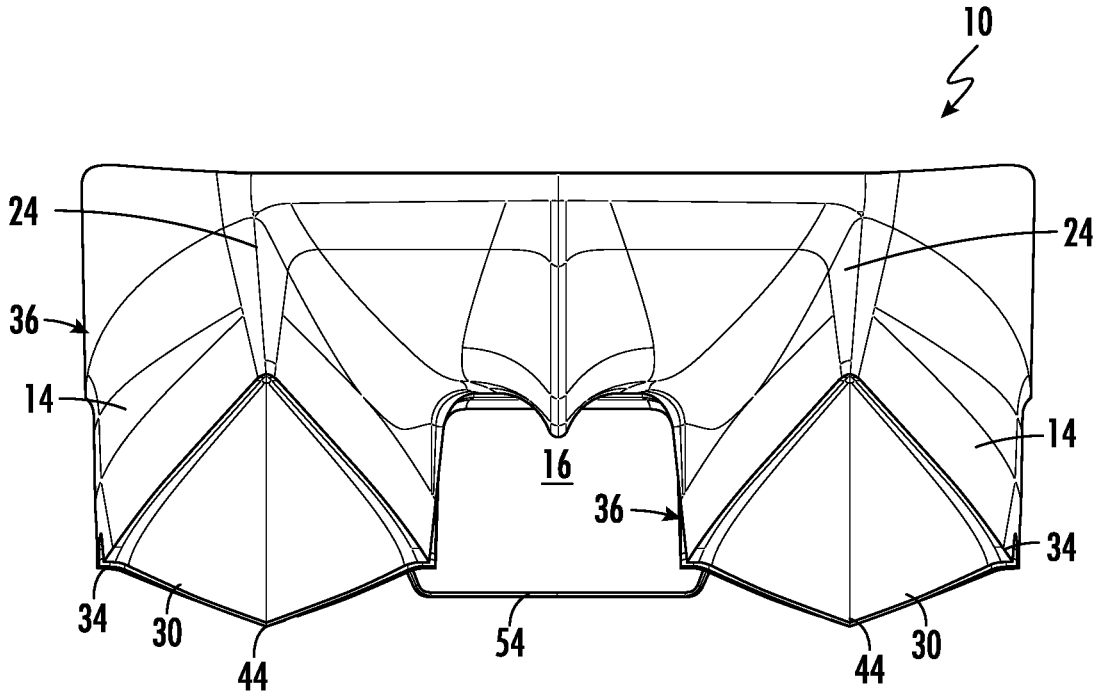
FIG. 6 is a front view of the vessel of FIG. 1, with the retractable foils retracted and with the alternate embodiment of a rear, fixed foil.

In the depicted embodiment, referring also to FIGS. 5 and 6, the multi-hull vessel 10 has two hulls 14 defining a single tunnel 16 therebetween. It will be appreciated that the present invention can be advantageously utilized with more than two hulls. For example, on tri-hull vessel defining two tunnels, a central hull could mount foils deploying and retracting from both sides-one into each tunnel, while the outer hulls would mount foils only on tunnel-facing sides in the same manner as the depicted embodiment.

Each of the depicted hulls 14 is advantageously a "stepped hull" having at least one step 22 formed between forward and aft ends 24, 26 thereof. As is known in the art, a step represents a vertical discontinuity in the hull moving forward to aft such that a bottom 30 disposed vertically higher aft of each step than forward thereof. Consequently, each step will have a vertical or otherwise upwardly angled aft face 32. While steps generally extend through chines 34, they typically do not extend up sides 36 of the hull. Preferably, however, the tunnel-facing inner sides 36 of each hull 14 preferably include upwardly extending foil recesses 40 (see FIGS. 3 and 4) in which portions of respective foils 20 are accommodated when retracted.

The depicted hulls each have two steps 22, and the retractable foils 20 are mounted aft of, and proximate to, the more forward steps 22. Preferably, a distance between a forward edge of each foil 20 and the aft face 32 of its step is less than a forward-to-aft width of each foil 20. It will be appreciated that the present invention could be realized in connection with hulls having fewer or more steps. Additionally, although, locating each retractable foil 20 aft of a step 22 is a highly advantageous embodiment, features of the present invention could be utilized in connection with hulls having no steps.

Figure 7:
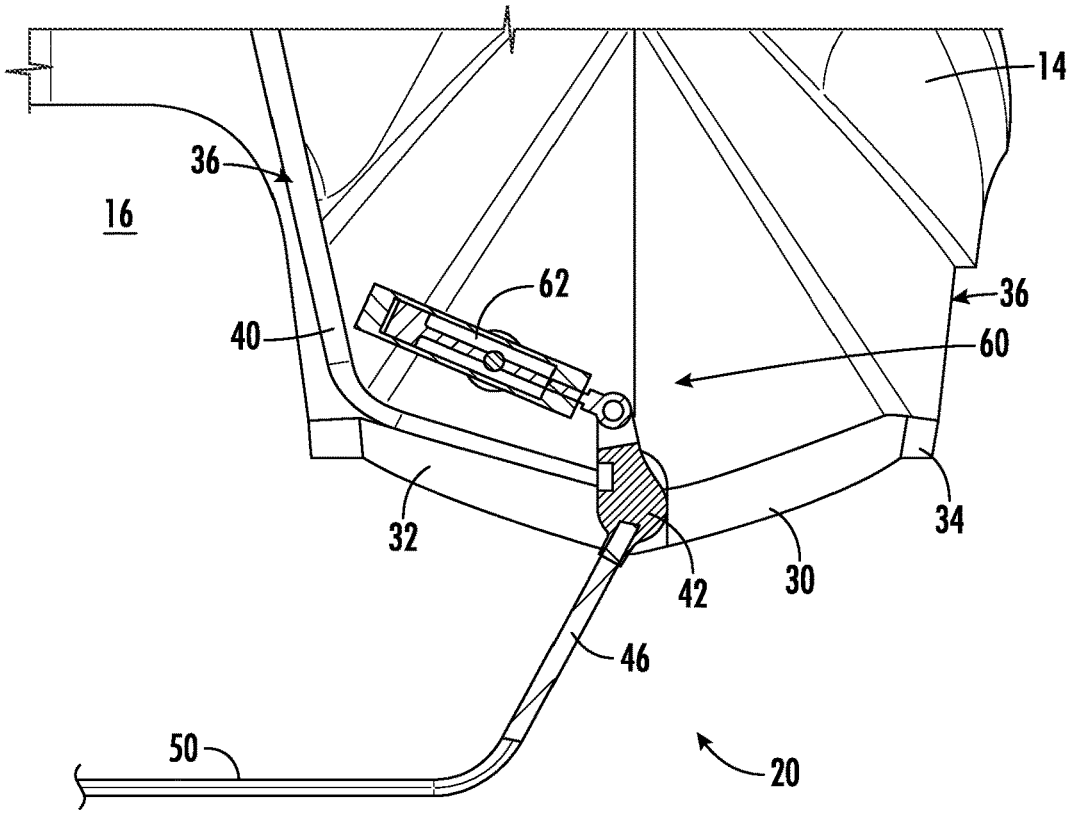
FIG. 7 is a cross-sectional view of an exemplary one of the retractable foils of FIG. 1, looking forward with the foil deployed.
Figure 8:
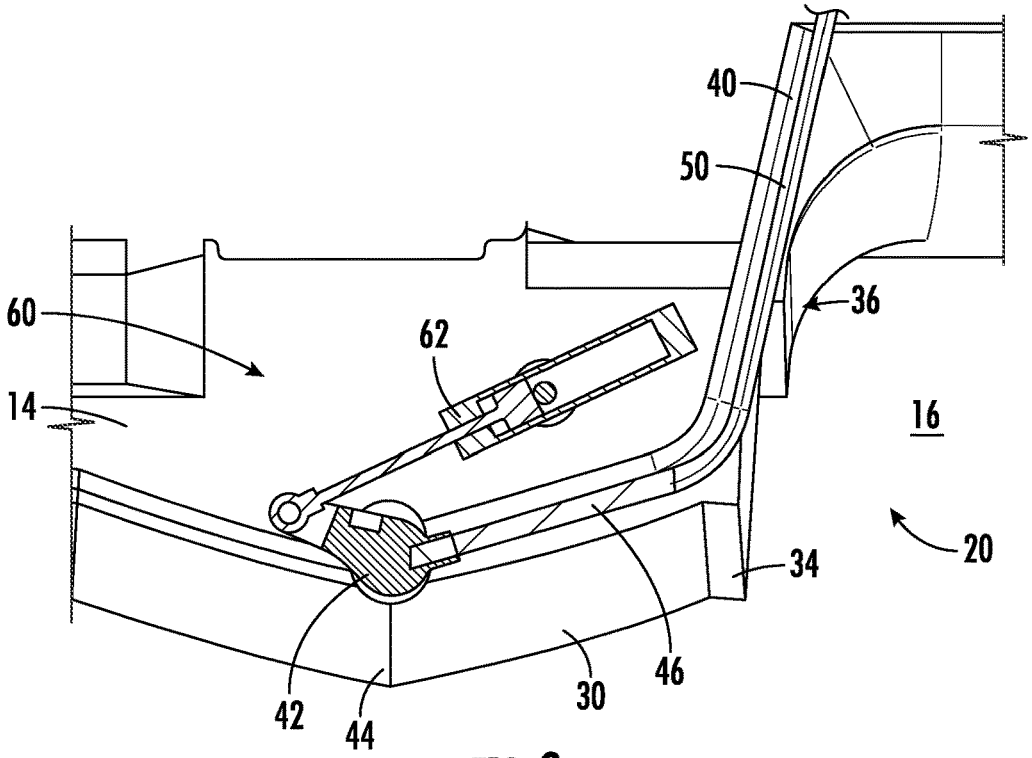
FIG. 8 is a cross-sectional view of the exemplary one of the retractable foils of FIG. 7, looking aft with the foil retracted.

Referring also to FIGS. 7 and 8, each of the retractable foils 20 of the system 12 includes a pivot structure 42 by which it is pivotably connected to the bottom 30 of its respective hull 14, preferably proximate a centerline 44 thereof. As used herein, a bottom-mounted structure is "proximate" the centerline if it is closer to the centerline than to either of the sides 36. Most preferably, the pivot structure 42 is mounted at the centerline 44 or offset therefrom by less than an overall width of the pivot structure 42 transverse the centerline.

Each pivot structure 42 is advantageously mounted and dimensioned such that all of the pivot structure 42 is behind the aft face 32 of its respective step 22, both when the corresponding foil 20 is deployed and retracted. As used herein, "all" of a component is "behind" the aft step when no portion of an aft step extends below the portion of the aft step located forwardly thereof. Consequently, the pivot structures 42 do not interfere with waterflow over the hulls 14 when the foils 14 are retracted nor when transitioning to and from foil-borne operation with the foils 14 deployed.

Each of the foils 20 preferably further includes a proximal foil section 46 attached to an extending from the pivot structure 42 and a distal foil section 50 extending at an angle of less than 180 degrees and, most preferably, an obtuse angle greater than 90 degrees. With the foils retracted 20, each proximal foil section 46 extends along the bottom 30 of its respective hull 14 aft of the step and all of the proximal foil section 46 is located therebehind.

Each distal foil section 50, when the foil 20 is retracted, extends up the inner, tunnel-facing side 36 of its respective hull 14 and is accommodated in the recess, such that no portion of the distal foil section 50 extends outwardly thereof into the tunnel 16. Each of the foils 20 can also include a distal tip 52 extending upwardly from the distal foil section 50 in the deployed position.

With the foils 20 retracted, they are difficult or impossible to see from outside the tunnel 16. In addition to exerting negligible impact on waterflow when the vessel 10 is hull-borne, the retracted foils 20 do not increase the hull-borne draft of the vessel. Furthermore, as it is difficult or impossible to even see the retracted foils 20 from outside the tunnel 16, the foils 20 do not affect the vessel aesthetics.

Referring particularly to FIGS. 5 and 6, in the deployed position, each proximal foil section 46 extends downwardly and inwardly (i.e., relative to the tunnel 16) from the bottom 30 of its hull 14 and the distal foil sections 50 extend towards one another. Advantageously, the distal foil sections 50 are both approximately horizontal and co-planar when deployed. With foils 40 also aligned across a width of the tunnel 16, the foils 40 effectively emulate a single solid foil extending between the hulls 14 and under the tunnel 16.

In addition to the retractable foils 20, the hydrofoil system 12 can advantageously include one or more fixed foils 54, 54A. In one embodiment (see FIGS. 2 and 6), a single foil 54 extends completely across an aft end of the tunnel 16, attaching to the bottoms 30 of the adjacent hulls 14 proximate inner chines 34 thereof. In another embodiment (see FIGS. 1 and 5), split foils 54A extend across the tunnel 16 towards one another from similar connection points on the hulls 14. While these smaller foils do not increase the maximum draft of the vessel 10, and are completely underwater when hull-borne, split foils 54A could still be made retractable in a manner similar to the foils 20 in implementations of the present invention.

Referring to FIGS. 7 and 8, the hydrofoil system 12 further includes a pair of pivot drives 60 mounted to respective hulls 14 and operable to drive respective foils 20 between the deployed and retracted positions. In the depicted embodiment, each pivot drive 60 includes a linear actuator 62 (such as the depicted hydraulic ram cylinder, an electromagnetic actuator, or the like) connected eccentrically to the pivot structure. Extending each actuator 62 retracts the respective foil 20 and retracting the actuator 62 deploys the foil 20. It will be appreciated that repositioning the linear actuator 62 could achieve the same result with the opposite action (i.e., extending the actuator to deploy the foil). Rather than directly engaging the pivot structure, a linear actuator could engage the foil via a rack and pinion-type arrangement. Also, other types of actuators could be used within the scope of the present invention, such as rotary actuators.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A marine vessel with a retractable hydrofoil system, the vessel comprising:

at least two connected hulls extending in a length direction between forward and aft ends and defining a tunnel therebetween, each hull including at least one step between the forward and aft ends, a bottom of each hull being disposed vertically higher aft of each step than forward of each step;

at least two foils, each foil being pivotally mounted below a waterline along an inner side of a respective one of the hulls that faces the tunnel, each foil being moveable between a deployed position extending downwardly and inwardly from the hull toward the other foil to a coplanar orientation across the tunnel, and a retracted position in which the foil is folded upwardly within a recess of the respective hull formed aft of the step such that no portion of the foil extends beyond a profile of the hull.

2. The marine vessel of claim 1, wherein each foil includes a pivot structure pivotably mounted to the bottom of the respective one of the hulls, a proximal foil section connected to the pivot structure, and a distal foil section extending at an angle of less than 180 degrees from the proximal foil section.

3. The marine vessel of claim 2, wherein, in the retracted position, the proximal foil section lies along the bottom of the hull aft of the step and the distal foil section extends along the inner side of the respective one of the hulls.

4. The marine vessel of claim 2, wherein the pivot structure of each foil is pivotably mounted proximate to a centerline of the bottom of the respective one of the hulls.

5. The marine vessel of claim 2, wherein all of each pivot structure is behind an aft face of the step of the respective one of the hulls.

6. The marine vessel of claim 5, wherein a distance between a forward edge of each foil and the aft face of step of the respective one of the hulls is less than a forward-to-aft width of each foil.

7. The marine vessel of claim 2, wherein each of the distal foil sections is horizontal in the deployed position.

8. The marine vessel of claim 7, wherein the angle between each of the distal and proximal foil sections is greater than 90 degrees.

9. The marine vessel of claim 2, further comprising at least two pivot drives, each of the pivot drives mounted to the respective one of the hulls and engaging a respective one of the pivot structures, each of the pivot drives being operable to pivot a respective one of the foils between the retracted and deployed positions.

10. The marine vessel of claim 9, where each of the pivot drives includes a linear actuator eccentrically connected to the respective one of the pivot structures.

11. The marine vessel of claim 1, further comprising at least one fixed foil connected between the hulls aft of the two foils.

12. The marine vessel of claim 11, wherein the at least one fixed foil extends completely between the hulls.

13. The marine vessel of claim 11, further comprising another fixed foil, the two fixed foils extending toward one another between the hull.

14. A method of operating a hydrofoil system of a multi-hull marine vessel, the method comprising:

deploying a pair of foils each pivotally mounted along an inner side of a respective hull below a waterline from opposite sides of a tunnel defined between adjacent hulls of the marine vessel such that distal sections of the foils extend inwardly toward each other beneath the tunnel and are aligned across a width of the tunnel in a coplanar orientation; and retracting each foil upwardly within a recess of the respective hull aft of a step such that no portion of the foil extends beyond a profile of the hull.

15. The method of claim 14, further comprising retracting the foils to a stowed position aft of steps formed in the adjacent hulls on opposite sides of the tunnel.

16. The method of claim 15, wherein deploying and retracting the foils include pivoting the foils via a pivot structure mounted aft of the steps proximate centerlines of the adjacent hulls.

17. A marine vessel with a retractable hydrofoil system, the vessel comprising:

at least two connected hulls extending in a length direction between forward and aft ends and defining a tunnel therebetween, each hull including at least one step between the forward and aft ends;

at least two opposed foils, each foil being pivotally mounted below a waterline to an inner tunnel side of a respective hull and movable between a retracted position entirely within a profile of the respective hull and received in a recess formed aft of the step and a deployed position extending downwardly and inwardly from the hull toward the other foil, with distal sections of the foils aligned across the tunnel width and coplanar.

18. A marine vessel with a retractable hydrofoil system, the vessel comprising:

at least two connected hulls extending in a length direction between forward and aft ends, each hull including at least one step between the forward and aft ends, a bottom of each hull being disposed vertically higher aft of each step than forward of each step; and at least two foils, each of the foils being pivotably mounted to the bottom a respective one of the hulls aft of the step, each of the foils being movable between a retracted position, in which the foil extends along the bottom of the hull aft of the step and up an inner side of the respective one of the hulls facing the other hull, and a deployed position, in which the foil extends downwardly from the bottom of the hull and toward the other foil;

wherein each foil includes a pivot structure pivotably mounted to the bottom of the respective one of the hulls, a proximal foil section connected to the pivot structure, and a distal foil section extending at an angle of less than 180 degrees from the proximal foil section;

wherein each foil further includes a distal tip extending upwardly from the distal foil section in the deployed position.

* * * * *